United States Patent [19]

Aunsholt

[11] 4,426,282

[45] Jan. 17, 1984

[54] PROCESS FOR THE SEPARATION OF COAL PARTICLES FROM FLY ASH BY FLOTATION

[75] Inventor: Knud E. H. Aunsholt, Roskilde, Denmark

[73] Assignee: Kryolitselskabet Oresund A/S, Copenhagen, Denmark

[21] Appl. No.: 348,102

[22] Filed: Feb. 11, 1982

[30] Foreign Application Priority Data

Feb. 16, 1981 [DK] Denmark ..... 664/81

[51] Int. Cl.[3] ..... B03D 1/14

[52] U.S. Cl. ..... 209/167; 106/288 B

[58] Field of Search ..... 209/2, 166, 167; 106/288 B, DIG. 1

[56] References Cited

U.S. PATENT DOCUMENTS

| | | | |
|---|---|---|---|
| 2,378,552 | 6/1945 | Hoag | 209/167 |
| 2,724,499 | 11/1955 | Smith et al. | 209/166 |
| 3,696,923 | 10/1972 | Miller | 209/166 |
| 4,121,945 | 10/1978 | Hurst et al. | 209/10 |

OTHER PUBLICATIONS

Flotation von Flugasche aus Kraftwerken by Moiset, delivered at the Fifth Int. Coal Prep. Congress in Aachen, Section A, Paper I, 1967.

Gaudin–Flotation, 2nd Edition, McGraw Hill, New York, 1957, pp. 532–543.

*Primary Examiner*—Bernard Nozick

*Attorney, Agent, or Firm*—E. Janet Berry

[57] ABSTRACT

Flotation of fly ash to recover coal contained therein is carried out in at least two steps, pH of the flotation slurry in the first step being 6–8, and in the last step lower than in the first step and below 6.5, preferably in the range of 3–5. The temperature may be ambient but is preferably 30°–60° C. As collector and frother several of those commonly employed are usable, preferably gas oil and pine oil, respectively. Desired pH is preferably achieved by sulphuric acid if desired in part by acidic flue gases. There is obtained separation into an almost carbon-free ash fraction and a carbonaceous fraction of low ash content.

12 Claims, 2 Drawing Figures

PROCESS FOR THE SEPARATION OF COAL PARTICLES FROM FLY ASH BY FLOTATION

FIELD OF THE INVENTION

The present invention relates to a process for the separation of coal particles from fly ash by flotation in water containing collector and frother.

Fly ash is produced in large amounts by combustion in power and heating plants, notably in coal-burning plants. About 99% of the fly ash produced is collected in the flue gas filters of the plants. The production of fly ash from coal-burning power plants in Denmark was in the year of 1980 about 1 million tons and with an increasing trend, and the annual production of fly ash from power plants in the U.S.A. is of the order of magnitude of 35–40 million tons.

The fly ash, notably from coal-burning plants, contains rather big amounts of unburned coal, thus from modern coal dust-burning plants of the order of magnitude 10–20%, from the nowadays more seldom employed, elder roast furnace plants up to about 50%. Hitherto, this quantity of coal has not been utilized but the coal particles have remained in the fly ash at the technical utilization or deposition thereof. Large amounts of fly ash are utilized for technical purposes, a.o. as road material, in the cement and concrete industry and as filler material, e.g. in dams and noise-protective walls. The utility of the fly ash would be greater and more versatile if it could be substantially freed from coal particles; and bearing the increasing coal prices in mind it is not economically justifiable to waste the large amounts of coal in the fly ash.

It is known to separate off coal from coal mining by flotation, see for instance the description pages 532–543 in Gaudin's book "Flotation", 2nd. edition, McGraw Hill, New York, 1957. The patent literature also contains several directions for separation of coal from accompanying minerals by flotation, a.o. GB Pat. Nos. 450,044 and 741,085 and from more recent time the German patent publications 27 40 548, 28 27 929, 28 53 410, 28 50 988, and 29 14 050. It has been found that it is not possible from the said literature to find directions concerning the flotation of fly ash.

In German Pat. No. 890,032 it has been suggested to separate fly ash into a fraction rich in coal and another poor in coal, either in a shaker hearth (Schüttelherd) or by flotation. No details on the conditions for flotation are given at all, such as suitable pH or temperature ranges, degree of aeration and kinds of reagents such as collector and frother.

U.S. Pat. No. 1,984,386 discloses a process of treating iron blast furnace dust or flue dust containing carbonaceous values, metalliferous values, and gangue, and in this process the starting material dust is subjected to a bubble flotation-treatment to produce a carbonaceous concentrate and a gangue containing the metalliferous values, after which the carbonaceous concentrate is subjected to a bubble flotation-treatment to produce a relatively pure carbonaceous material, and likewise the gangue containing the metalliferous values is subjected to another further bubble-flotation. The specification does not contain any details on acidity of the slurry for the bubble flotation, but it does suggest to carry out the purification of the carbonaceous concentrate in one or more bubble flotations in one or more baths having present a gaseous medium strongly and controllably charged with electrical ions. The specification does not contain examples allowing the reader to evaluate the degree of purity of the carbonaceous fraction and the gangue fraction obtainable.

Belgian Pat. No. 633,634 describes the recovery of coal from fly ash by flotation and the method described is further elucidated in a paper by P. Moiset, "Flotation von Flugasche aus Kraftwerken" in a report from Fifth International Coal Preparation Congress (in Aachen). Section A, Papier I, 1967. Neither the patent specification nor the article contains much information on the technical conditions of a successful accomplishment of the flotation; thus, a.o., they say nothing on the acidity or temperature of the flotation slurry. The paper reports a series of experiments. By flotation of a fly ash from a mine power station and having an ash content of 64.25% there could be obtained a coal fraction containing 98.2% of the coal content of the fly ash, but having an ash content of 46%. As collector/frother there was used 90% by weight of a fuel oil not more fully defined, and 10% of ethylisobutylcarbinol. This fly ash contained about 50% particles having a particle size above 100μ and about 16% having a particle size below 10μ. By experiments with a somewhat more fine-grained fly ash from various power stations there was obtained recovery of 70–93% of the coal content of the ash, as carbon fractions containing 50–77% of ash, i.e. very impure coal fractions. In some of the experiments the coal fraction was re-flotated; this caused a rather considerable further coal loss and yet it was not possible to achieve an ash content in the coal fraction below 26.6%. As far as is known, the above method has never been utilized in practice.

Accordingly, there is a need for providing a flotation process wherein on one hand it is possible to recover a high proportion of the coal content even of fine-grained fly ash, and on the other hand to recover this coal content as a comparatively pure coal fraction, i.e. a coal fraction having a low ash content. It is observed that the quality of the coal from which the fly ash originates sets a limit for the purity of the coal fraction even if the precize position of this limit is not known.

Fly ash consists of discrete particles the particle size of which in fly ash from coal dust burning plants mainly is 3–300μ and from roast furnace plants (stoker plants) 5–500μ; in road technology terminology accordingly the fractions extend from the fine silt fraction to the intermediate and coarse sand fractions, respectively.

The fly ash particles are mainly spherical, but often hollow. The coal particles have a more irregular shape and contain substantially only coal, the particles of other substantially no coal even if mixed particles may occur. The fly ash from coal burners is rather strongly alkaline.

RECENT INVESTIGATIONS

Partly the publications mentioned contain information on, a.o., frother and collector for flotation of fly ash and frother, collector and flotation promoters for flotation of coal from surface mining and underground mining, but still nothing from which it is possible to conclude which measure to take in order to efficiently flotate coal contained in fly ash. In the investigations which resulted in the present invention, it was soon found that a decisive factor is the pH value and regarding this no other information can be gathered from the literature than the fact that a couple of patent publications peripherally mention that one possible flotation additive is a pH regulator, without mentioning the pH at which to adjust pH. Thus, it is merely a piece of general information applicable to flotation in general.

The investigations showed that the flotation could be conducted to recover a rather good proportion of the coal content of the fly ash, and also having a tolerable quality, i.e. without excessive amounts of accompanying substances, if the pH of the flotation liquid were maintained within the range of 3–8. The purity of the coal, however, was not quite satisfactory when operating in the upper part of the range (pH 6–8), and if the flotation was conducted in the lower part of the pH range the acid comsumption became very high, which firstly reduced the process economy and secondly caused a considerable part of the other components of the fly ash to become dissolved and to give pollution problems and render recycling of the process water impossible. In a series of experiments, partially reported hereinafter, it was found that the problem could be solved if the flotation was carried out in at least two steps, pH being around the neutral point in the first and in the moderately acidic range in the second step.

In accordance with this, the process according to the invention is characterized in that the flotation is carried out under vigorous aeration and in at least two steps, pH being adjusted in the first step at a value between 6 and 8 and in last step at a lower value than that employed in the first step, said lower value being pH 6.5 or lower.

To some degree the pH in the last step depends on how alkaline (or acidic) the starting fly ash is, but a main consideration in determining pH in the last step is the amount of acid to use to obtain it, another the effect on the water in which the fly ash is slurried. According to the invention it is ordinarily preferable to carry out the last step of the flotation in the pH range of 3–5.

In this manner there is achieved a process which is inexpensive to carry out since the use of acid for the neutralisation and acidification of the fly ash slurry becomes low, and which gives a most efficient separation of the coal fraction and the mineral fraction with very little coal left in the mineral fraction and a low amount of mineral impurities in the coal fraction. The low acid comsumption causes that only a small amount of the mineral substances become dissolved, and therefore the water may be re-used, i.e. recycled for renewed use in the flotation process, which is very important in order to obtain optimum process economy.

EMBODIMENTS OF INVENTION

The first step may optionally be subdivided into a plurality of sub-steps in series and in these one may, if desired, vary the pH value of the flotation slurry within the stated range of 6–8. If pH is above 8 the separation will become too poor, too much coal accompanies the mineral fraction unless it is re-flotated. If pH is above 8, a re-flotation in the pH range of 6–8 may therefore be needed whereby the acid saving obtained in the first instance by virtue of the high pH value is more than offset by the necessity of re-flotation.

When the first step has been concluded and the major part of the mineral fraction separated off as a bottom fraction, which in known manner is sent to a thickener and then recovered for technical utilization or deposition, the frothed top fraction is sent to the second step, which may likewise if desired be subdivided into a plurality of sub-steps in series. As the major part of the alkaline minerals have now been removed, the acid consumption to obtain a desired, comparatively low pH value is modest and the decreased amount of mineral matter ensures that only a small amount is dissolved, whereby the water is not polluted so much that it cannot be recycled for renewed use as flotation liquid, or may be led away to a recipient.

It has been found that pH in the last step may be up to 6.5 provided it is lower than in the first step, i.e. if the first step has been carried out at pH above 6.5 and preferably near 8. However, operating the last step at such high pH is not normally advantageous with a view to the purity and hence burning value of the recovered coal fraction. Therefore, according to the invention the last step is advantageously carried out at a pH in the range of 3–5, which normally will ensure resonably high purity and hence calorific value of the coal fraction. It may frequently be advantageous to subdivide the last step into sub-steps (see experiments hereinafter), and in that case one may, if desired, decrease pH gradually from one step to another. The first of these sub-steps in some case may advantageously be a kind of transitional step operating at a pH near the upper limit of pH 6.5. The lower limit of pH 3 is only critical in the sense that below that one does not obtain a further improved purity of the coal so that the acid consumption will be too high without any advantage being achieved thereby.

In principle the desired pH value may be obtained by the aid of any acid whereby the choice of acid first and foremost is made with regard to the process economy. However, hydrochloric acid is undesirable because of its comparatively high volatility, and a number of acids will be undesired for environmental reasons, for instance because they give undesired effects in the recipient in which the acid ends up at last. In practice sulphuric acid is preferred according to the invention because in most cases it is the least expensive acid, calculated per acid equivalent, and is not very critical from an environmental point of view. In some cases, for instance near paper and cellulose factories, sulphonic acids might be available in large amounts and may be suitable.

In practice it is most convenient that the amount of acid needed for adjusting pH in the first step is added in a mixing vessel where the fly ash is mixed with the water to use in the flotation, whereas the acid to adjust pH in the last step is added directly in the vessel or vessels in question.

According to the invention it may be advantageous entirely or partially to establish the desired pH by conducting acidic flue gasses through the slurry. This may improve the process economy further, notably where the flotation plant is placed at the burner plant in question.

The temperature at the flotation may be ambient temperature, even in winter, only the water does not freeze, but is frequently at least 15° C. because the consumption of chemicals (frother and collector) otherwise may be too big and the flotation process too slow.

However, according to the invention it is preferred that the temperature during the flotation is between 30 and 60° C. It may be particularly advantageous to operate near the upper end of this range because thereby there may be obtained some saving in the chemicals consumption. This, however, is not the only parameter determining the operating temperature since heating of the flotation material should preferably be avoided for the sake of the process economy. It will not normally cause any problems to maintain the temperature at a suitable level. The flotation plant, which does not require any big capital investment compared to the possible gain, should be present at the very power station or other works the fly ash of which is to be flotated, since too big transport costs will lower the total economy of the process. The fly ash is removed from the flue gas filters at a temperature of 100°–120° C. and thus may supply the desired heat to the flotation water.

It is important to ensure a good stirring and a good aeration in the flotation vessel since even thereby some saving in the chemicals consumption may be achieved. Addition of air and stirring or other active movement of the flotation liquid are narrowly inter-connected factors so that a good stirring, which is well effective in the entire volume of the flotation vessel, may lower the needed degree of aeration somewhat. As a main rule it is according to the invention desirable to aerate with an amount of air per minute of at least the same volume as the volume of the flotation liquid.

As collector one may use a number of the oil based collectors commonly employed in flotations. It is particularly convenient to use mineral oil fractions predominating containing $C_{5-10}$ hydrocarbons, both aliphatic and aromatic ones. In practice it is preferred according to the invention to use gas oil. The amount of collector is not very critical, but in the interest of the process economy it should be kept as low as possible. In practice the amount of collector will be of the order of magnitude of 5–15 liters per ton of fly ash.

As frother a number of those well-known in the flotation technique may be used. Especially usable are various terpene oils (terpene alcohols), but also cresylic acids and similar compounds may be used. According to the invention pine oil has been found particularly useful. Pine oil is commercially available both as natural vegetable pine oil and as synthetic pine oil. The former has the advantage of acting to some degree also as a collector and is needed in a slightly lesser amount than the synthetic pine oil, which on the other hand is somewhat less expensive. According to the invention the amount of frother is expediently about 4% by weight of the amount of collector.

Ordinarily other chemicals are not needed for the flotation but it may be convenient to add a small amount of dispersant, preferably a polyglycolether; this may especially be appropiate when flotating deposited fly ash. A real emulsifier to ensure a good dispersion of the collector in the flotation water may be expedient, but because of the desirable vigorous aeration and stirring it is usually not necessary.

Other regulation agents known in flotation technique may be added as needed, but are usually not necessary. Thus, it is normally not necessary to add neither activators such as copper sulphate or depressants such as iron (II) compounds or sodium cyanide. Flocculants are superfluous.

The chemicals are added to the flotation liquid for the first step where the flotation is operated at the higher pH, and there are not added further reagents (collector, frother etc.), apart from acid, to the last step where the process is operated at the lower pH. But on the other hand it has been found expedient to add about half of the chemicals (other than the acid for adjusting pH) in a conditioning vessel where the flotation slurry gets a short residence before the commencement of the flotation, whereas the remainder is added during the flotation in the first flotation step. It is hereby obtained that the flotation starts effectively as soon as the slurry has entered the flotation vessel. If the first step has been subdivided into several part steps carried out in vessels placed after each other in series, it may be expedient to divide the addition of the last half between some or all of these part steps. On the other hand there is not added further chemicals in the last flotation step (at the lower pH).

The collector reagent follows the coal fraction and increases the calorific value of the coal.

The amount of fly ash slurried in the flotation water, the socalled pulp density, is not very important. In a series of experiments there has successfully been operated at a pulp density partly of 10%, partly 15%; in industrial scale it may possibly be advantageous to operate at a bit lower values, yet dependant on temperature since higher temperatures allow a higher pulp density than lower temperatures. According to the invention there is expediently operated at an amount of fly ash of 5–16% by weight of the amount of water used in the flotation.

DETAILED DESCRIPTION OF THE INVENTION

Figure 1:
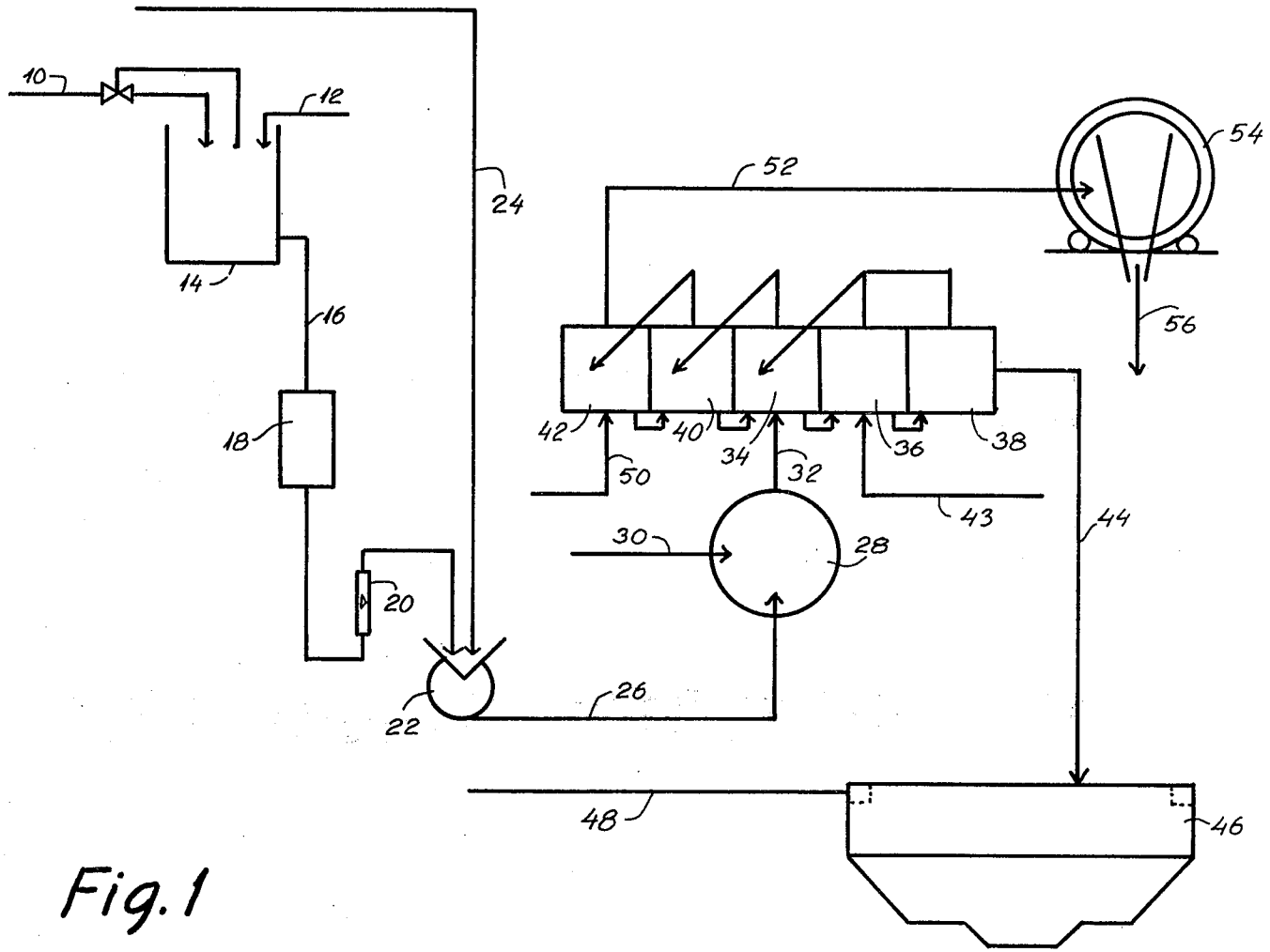
FIG. 1 shows a flow sheet of the practical operation of the process according to the invention, and FIG. 2 a known flotation apparatus in which a series of laboratory experiments have been carried out.

The practical operation of the process according to the invention will now be described more detailedly with reference to FIG. 1.

Water from line 10 and sulphuric acid (or other desired acid) from line 12 are mixed in mixing vessel 14 in such amounts that a slurry therein of fly ash in pump 22 and later members obtain a pH in the range of 6–8. From mixing vessel 14 the acidic water passes via line 16, with heat exchanger 18 and flowmeter 20, to pump 22, in which the fly ash, preferably still hot from the flue gas, is admixed from the flue gas filter or a silo via a dosage screw (not shown) and conveyor 24.

The amount of fly ash is conveniently about 10% by weight of the acidic water mixed in the mixing vessel, and the slurry formed is passed through line 26 to a conditioning vessel 28 in which about half of the desired amount of collector, frother and optionally dispersant and other chemicals is added. It is preferred to use 4% synthetic pine oil (such as "Dertol") in gas oil, optionally admixed with about 1% of poly(glycolether) as dispersant. In the conditioning vessel the slurry suitably has a residence time of 5–10 minutes and is thereafter conducted via line 32 to the flotation aggregate which in the flow sheet comprises five flotation cells 34, 36, 38, 40, and 42 in series. Of these, cells 34, 36, and 38 represent the first flotation step which accordingly is subdivided into three part steps; and cell 42 the last step since the adjustment of pH at below 6.5 and preferably at 3–5 directly takes place in cell 42. It is justified to regard cell 40 as representing an intermediate step between the first and last flotation steps, pH in cell 40 not being much lower than pH of the slurry in cell 34. However, acid might be added in cell 40, whereby the last flotation step (lower pH) would comprise two part steps.

In cell 34 an incipient flotation takes place under the influence of the chemicals added in the conditioning vessel 28. The flotated (frothed) carbonaceous phase, i.e. the top phase, as intimated by an arrow is conducted to cell 40 which, as will be understood is a transition between first (pH 6–8) and last (pH 3–5) flotation step. The effect of acid addition in cell 42 only faintly manifests itself in cell 40. The predominantly ash-containing bottom phase from cell 34, as also intimated by an arrow, flows to the second part step of the first flotation step, i.e. cell 36. In the embodiment shown the remainder of the chemicals (collector, frother, dispersant) is added in cell 36 via line 43. The coal phase frothed in cell 36 passes to cell 34 and from there by the flotation further on to cell 40, whereas the ash phase from flotation cell 36 passes to cell 38. Frothed carbonaceous top phase from cell 38 goes directly to cell 34 together with that from cell 36, whereas the ash phase is removed via line 44 and conducted to a thickener 46. In this there is separated an ash fraction which is discharged for technical use or deposition, and recycle water which is preferably conducted via line 48 to pump 22, but which if desired alternatively may be conducted to mixing vessel 14 or to a recipient.

From cell 40 the top fraction, i.e. the carbonaeous flotated froth, is conducted to the last flotation step, represented by cell 42. In this the ultimate separation of coal and ash takes place, and in order to render it as efficient as possible and thereby ensure the lowest possible ash content in the coal fraction, further sulphuric acid (or other chosen acid) is added in cell 42 via line 50 so as to achieve a pH value in cell 42 in the range of 3 to 5. The liquid phase is returned to cell 40 and the coal froth fraction passes via line 52 to a vacuum filter 54 where it is separated as a filtered coal fraction 56.

The cells 34–42 may be of known kind, and each of them is in known manner provided with a stirring aggregate and supply means for air. Each cell may have a size of, for example, 1.5 $m^3$ so as to easily hold 1 $m^3$ of fly ash slurry. Under this assumption there is expediently aerated in each cell with an amount of air of 1000–1400 liters per minute. At such rate of aeration the typical residence time for the slurry in each cell will be 3–5 minutes. Sometimes shorter or larger residence times will be used, for instance within the range of 2–15 minutes.

The aggregate shown may be used both for continuous and discontinuous flotation. The number of cells may vary within wide limits. In practice there are suitably 2–4 part steps in first and 1–3 part steps in last flotation step.

In the following, the process according to the invention will be illustrated more fully by some experiments.

TEST SERIES 1

Figure 2:
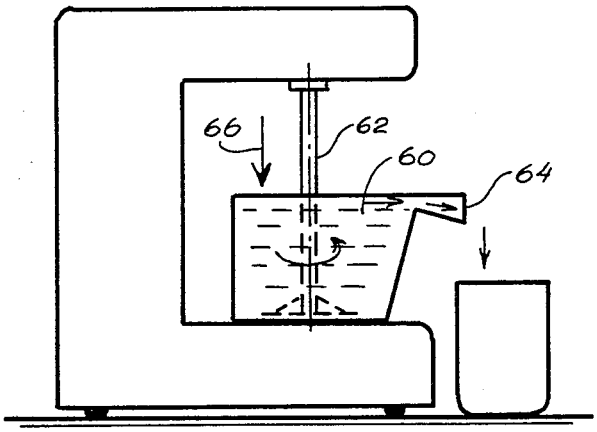

Some experiments were carried out in a commercial flotation apparatus for laboratory use (supplied by "Westfalia Dinnendahl Gröppen AG", Bochum,Germany), shown schematically in FIG. 2. Essentially it consists of a flotation cell 60 in which there is immersed a rotating aerator 62 through which air is added, and which also acts as a stirrer. The carbonaceous froth is discharged via a spout or lip 64, and the ash phase is merely collected from the remaining liquid. The cell 60 has a size so as to be capable of flotating 3 liters of slurry or fly ash at a time. In the experiments the slurry contained either 300 or 450 g of fly ash (10 or 15%). pH can be adjusted by the aid of pH regulators 66, not detailedly shown, whereby they operate the addition of sulphuric acid.

The experiments were carried out with fly ash from a coal-burning roast furnace at Sakskøbing Sugar Factory, Denmark. The coal content of the fly ash was about 50%. All determinations of coal contents have taken place as measurements of loss of ignition. pH was adjusted automatically with 50% sulphuric acid. In all of the experiments there was employed 0.5 ml synthetic pine oil ("Dertol") as frother, irrespective of the amount of fly ash, and 6–12 ml of gas oil as collector; the frother was added before, the collector after start of the aeration. The froth was scraped off by a manual scraper in each experiment and was discontinued when visually there could clearly be seen division into an ash fraction (light) and a coal fraction (dark). The duration of the individual experiments was 5–12 minutes.

Results are shown in Table 1.

TABLE 1

| | Series of tests in laboratory scale without reflotation. | | | | | | | |
|---|---|---|---|---|---|---|---|---|
| | Fly Ash | | Flot. | | Coal Fraction | | Ash Fraction | |
| Exp. No. | weight g | carbon content | temp. °C. | pH | weight g | carbon content | weight g | carbon content |
| 1 | 450 | 51,5% | 28 | 8–9 | 254 | 69,1% | 179 | 26,4% |
| 2 | 300 | 53,9% | 40 | 6 | 204 | 88,8% | 79 | 4,4% |
| 3 | 300 | 48,8% | 50 | 6 | 199 | 87,5% | 85 | 3,1% |
| 4 | 300 | 52,3% | 33 | 6 | 197 | 88,1% | 91 | 5,4% |
| 5 | 450 | 46,5% | 32 | 5 | 284 | 88,3% | 148 | 7,1% |
| 6 | 450 | 51,7% | 30 | 5 | 284 | 90,3% | 147 | 5,7% |

When the sum of the weight of the coal fraction and the ash fraction does not equal the weight of the starting material, this is due to the fact that some solid matter is dissolved in the acid-containing water. This forbids the re-use of the water for flotation and is a drawback in discharging the water to a recipient.

Experiment No. 1 shows that the result of operating at pH above 8 is unsatisfactory. The separation is poor so that there is too much ash in the coal fraction and too much coal in the ash fraction. The other experiments show a tendency to improved purity of the coal fraction with decreasing pH. A comparison of experiments 2–4 suggest a tendency to decreased coal content in the ash fraction with increasing temperature within the range investigated. The difference between experiments 5 and 6 is that there was employed 12 mls of gas oil in the former, 6 in the latter; thus there may be a tendency to improved separation at decreased chemicals consumption within effective amounts of chemicals.

In all of the experiments the consumption of reagents and of acid were comparatively high, so high as to cause a rather unsatisfactory process economy by conversion into operation in technical scale. Therefore, experiments have been carried out with a view to improving the process economy.

TEST SERIES 2

In these experiments fly ash from a coal-dust burning power station, the Asnæs Works in Western Zealand (Denmark) was flotated. It contained about 11.5% carbon, measured as ignition loss after 10 minutes combustion at 1200° C.

A particle size distribution curve for fly ash from the Asn s Works shows that about 50% to 90% has a particle size below 50μ and from 10% to 35% a particle size below 10μ. The particle size is substantially smaller than the particle size of the fly ash employed in test series 1, although no sieve analysis has been made of that.

The purpose was initially to test pH variations at two different pulp densities, 10% and 15%.

There was used the test apparatus shown in FIG. 2 and having a capacity of 3 liters. The aeration rate was 4 l/min., speed of the stirrer was 1800 r.p.m., the temperature 35° C., the flotation period 12 minutes and the amount of reagent 3 ml consisting of 2.5 ml of gas oil and 0.5 ml synthetic pine oil. The amount of water was 3 liters, the amount of fly ash either 450 g or 300 g.

The results are shown in Table 2. By "% carbon recovered" is meant the proportion of the carbon content of the fly ash that was recovered in the coal fraction obtained by the flotation.

TABLE 2

Variation of pH in flotation without re-flotation of fly ash containing a moderate amount of carbon

| | | | | Coal fraction | | | Ash fraction | |
|---|---|---|---|---|---|---|---|---|
| Exp. No. | Fly ash, g | pH | Acid consumed, ml 4N $H_2SO_4$ | weight, g | carbon content % | % carbon recovered | weight, g | carbon content, % |
| A-1 | 450 | 6 | 6 | 98 | 47,2 | 89,5 | 350 | 1,2 |
| A-2 | 450 | 8 | 2,5 | 112 | 40,8 | 88,2 | 335 | 1,8 |
| A-3 | 450 | 4 | 22 | 77 | 60 | 89,2 | 359 | 1,3 |
| A-4 | 300 | 4 | 18 | 53 | 60,5 | 93,0 | 239 | 1,2 |
| A-5 | 300 | 8 | 1 | 63 | 48 | 87,5 | 235 | 1,8 |

The fly ash from coal-dust burning plants has far finer particles than the fly ash in test series 1, and the A-tests in test series 2 show that by flotation of a fine grain fly ash with comparatively low carbon content there can be obtained a very low content of carbon in the ash fraction, whereas the ash content in the coal fraction is undesirably high so that a re-flotation is desirable; from test series 1 it is seen that the ash content by flotation of fly ash with a carbon content of about 50% can be reduced very substantially.

Comparison of experiments A-2 with A-5 and of A-3 with A-4 show that, under the operation conditions chosen, it does not make any difference whether the pulp density is 10% or 15%. The experiments at pH 4 gave the best quality of the coal fraction, whereas the quality was markedly poor in the experiments with pH 6 and 8. Addition of the amount of material recovered (sum of coal fraction and ash fraction) shows that the loss of material was very low in the experiments with pH 6 and 8. This means that only very little material has been dissolved in the flotation water, which therefore may be re-used for reflotation or for flotation of another charge; or without much scruple may be discharged to a recipient after removal of the collector and frother reagents. In the experiments at pH 4 the loss of materials was consirably bigger, 14 g and 8 g (3.1% and 2.7%), mainly of calcium compounds dissolved. This water is not fit for recycling because thereby a further concentrating will take place. In an experiment with flotation at pH 6 and 16° C. largely the same results were obtained as in experiment A-1.

Thereafter, experiments were carried out with a single reflotation of the froth containing the coal fraction. In order to obtain a reasonable amount of carbonaceous froth for reflotation, the first flotation in these experiments was carried out as two flotations in parallel, from which the flotated froth containing the coal fraction was united for reflotation together.

These experiments are denoted B-1, B-2 and B-3. The experiments were conducted with the same fly ash as those denoted A and in both steps under the same conditions with respect to aeration, stirring rate, temperature, flotation period and amount of reagents as the A-experiments.

The two first-flotations in experiment B-1 were conducted each with a pulp density of 15% and pH 8. The ash fractions were 337 g and 335 g, respectively, with a carbon content of 1.7% and 2.0%, respectively; the consumption of 4N $H_2SO_4$ was 2 ml for each of the two charges.

The two first-flotations in experiment B-2 were carried out at a pulp density of 15% and pH 6. The ash fractions were 349 and 348.5 g, respectively, with carbon contents of 1.8% and 1.9%, respectively; the consumption of 4N $H_2SO_4$ was 2.5 ml for each of the charges.

The two first-flotations in experiment B-3 were carried out with a pulp density of 10% and pH 8. The ash fractions were 238 g and 239.5 g, respectively and having a carbon content of 2.5% and 2.8%, respectively; the consumption of 4N $H_2SO_4$ was 1.5 and 1 ml, respectively.

The unified froths containing the coal fractions was thereafter subjected to reflotation at a lower pH as appears from Table 3 below.

TABLE 3

Tests with one reflotation of a coal fraction of fine grain fly ash having moderate carbon content.

| | Second step | | Coal fraction | | | Ash fraction | | | |
|---|---|---|---|---|---|---|---|---|---|
| | | | | | | 2nd step | | total | |
| Exp. No. | pH | ml 4N $H_2SO_4$ | weight, g | % carbon | % carbon recovered | weight g | % carbon | weight g | % carbon |
| B-1 | 5 | 6 | 148 | 60 | 84,9 | 69 | 2,6 | 741 | 1,9 |
| B-2 | 5 | 4 | 141 | 64 | 85,8 | 51 | 2,6 | 749 | 1,9 |
| B-3 | 4 | 8 | 82 | 68 | 80,9 | 36,5 | 3,2 | 514 | 2,6 |

The total acid consumption in the flotation plus reflotation thus was 10 ml in B-1, 9 ml in B-2 and 10.5 ml in B-3, i.e. about half of the consumption in experiments A-3 and A-4.

A comparison between experiments A-1 (pH 6) and B-2 (pH 6 in the first step) shows that the reflotation yielded a considerably improved coal fraction without a very big increase in acid consumption. The same result appears by a comparison of A-2 (pH 8) with B-1 (pH 8 in the first step); and of A-5 (pH 8) with B-3 (pH 8 in the first step) O. A-5 and B-3 also suggest that the decreased pulp density is advantageous for the purity of the coal fraction, but that it causes a somewhat increased coal loss.

The loss of material (dissolution in the acid-containing water) was remarkably low in experiment B-3, only 4 g, so that the water may be recycled without any hesitation.

It was found in connection with the B-experiments that it is important to maintain a good speed of the stirrer since otherwise the froth will become too voluminous because the bubbles grow too big.

In a further experiment there were conducted two reflotations at low pH. This experiment was carried out with the same fly ash and the same test conditions as the A- and B-experiments, double flotation (2×450 g) being employed in the first step as in the B-experiments. In the first step the temperature was 36° C., pH 7 and the acid consumption 2×2.5 ml 4N $H_2SO_4$.

Thereafter there was flotated twice at 35° C., here denoted second step and third step. In both of these pH was 4 and the consumption of 4N $H_2SO_4$ was 9 ml and 2 ml, respectively, thus altogether 16 ml for all of the three steps. The coal fraction from the last flotation was 122 g containing 74% carbon, corresponding to a carbon yield of 88%. The ash fractions from all of the three steps weighed 775 g, having a carbon content of 1.5%.

EXAMPLE

Flotation has been conducted in technical scale in a plant as shown schematically in FIG. 1, yet without full optimation of the various parameters. Each of the flotation cells has a capacity of 1 $m^3$ of flotation liquid and the mixing vessel a capacity of 1.5 $m^3$. The flotation was conducted continuously and as collector/frother reagent there was employed 4% "Dertol" in gas oil. There was maintained a temperature of 32° C. and a pulp density of about 7%. pH was adjusted at 6 with 50% sulphuric acid in the mixing vessel and was thereafter 6.3 in the first four flotation cells, whereas it was adjusted at 3.8 by further addition of sulphuric acid in the last cell.

The result were:

| | | Coal fraction | | | | |
|---|---|---|---|---|---|---|
| Fly | Ash | | % | carbon | Ash fraction | |
| kg/h | % carbon | kg/h | carbon | yield % | kg/h | % carbon |
| 1103 | 10,2 | 146 | 71 | 92,0% | 957 | 0,8 |

The addition of reagent (collector/frother) was 7.3 l/h corresponding to 6.6 liters per ton.

In a corresponding operation with fly ash which had been deposited for two years, the same result was achieved.

I claim:

1. In a process for the separation of coal particles from fly ash by flotation in water containing at least one collector and at least one frother, whereby a comparatively pure coal fraction is obtained as a top froth fraction, and a substantially non-carbonaceous ash fraction is obtained as a bottom depressed fraction, the improvement of carrying out said flotation under vigorous aeration in at least two steps, the froth of the first step forming a substantial part of the feed of the last step, in which the pH is adjusted to a pH of 6 to 8 in the first step and to a pH of 3 to 6.5 in the last step, and in which the pH is lower in the last step than in the first step.

2. A process as claimed in claim 1, wherein the flotation is operated in the last step at a pH in the range of 3 to 5.

3. A process as claimed in claim 1, wherein pH is adjusted at least partially by the aid of sulphuric acid.

4. A Process as claimed in claim 1, wherein pH is adjusted at least partially by the introduction of acidic flue gases.

5. A process as claimed in claim 1, wherein the temperature of the flotation liquid is maintained between 30° C. and 60° C.

6. A process as claimed in claim 1, wherein there is aerated in each flotation vessel with an amount of air per minute of at least the same volume as the volume of the slurry of fly ash in that vessel.

7. A process as claimed in 1 wherein one (a) forms an aqueous slurry of the fly ash to be flotated, (b) adjusts pH of said slurry at 6–8, (c) passes the slurry, at pH 6–8, to a conditioning vessel and in that conditioning vessel adds about half of the collector, frother and dispersant to employ, (d) after the addition of said chemicals maintains the slurry in said conditioning vessel for 2–15 minutes, (e) passes the conditioned slurry to a flotation vessel and adding the remainder of the predetermined amount of collector, frother and dispersant to the slurry in the flotation vessel during the first step of flotation, and (f) after having concluded the first flotation step passes the slurry to the last flotation step and adjusts there pH to the desired value of 3 to 6.5, and (g) recovers a substantially purified coal fraction in the froth obtained by the last flotation step.

8. A process as claimed in claim 1, whereby the slurry to be flotated is maintained at a pulp density of 50 to 160 kg per ton of flotation water.

9. A process as claimed in claim 1, wherein gas oil is used at least as part of the collector.

10. A process as claimed in claim 1, wherein at least part of the frother is selected from the class consisting of synthetic pine oils and vegetable pine oils.

11. A process as claimed in claim 1, wherein a small amount of dispersant is present in the slurry of fly ash to be flotated.

12. A process as claimed in claim 11, wherein the dispersant is at least one polyglycolether.

* * * * *